United States Patent [19]

Gregory et al.

[11] Patent Number: 4,762,273

[45] Date of Patent: Aug. 9, 1988

[54] ELECTRONIC FAUCET WITH SPOUT POSITION SENSING MEANS

[75] Inventors: Stephen O. Gregory, 2508 Arapahoe St., Denver, Colo. 80205; Michael W. West, Denver, Colo.; James L. Wolf, Lakewood, Colo.; Daniel V. Sallis, Littleton, Colo.

[73] Assignee: Stephen O. Gregory, Denver, Colo.

[21] Appl. No.: 46,064

[22] Filed: May 4, 1987

Related U.S. Application Data

[63] Continuation-in-part of Ser. No. 837,409, Mar. 7, 1986, Pat. No. 4,735,357.

[51] Int. Cl.[4] ..... E03C 1/05

[52] U.S. Cl. ..... 236/93 R; 4/623; 137/801; 251/129.04

[58] Field of Search ..... 236/12.12, 93 R; 4/623, 4/192; 137/615, 801; 251/89, 129.04

[56] References Cited

U.S. PATENT DOCUMENTS 3,556,146 1/1971 Groen ..... 137/801 X
3,884,258 5/1975 Mull ..... 137/801

FOREIGN PATENT DOCUMENTS 1937378 8/1970 Fed. Rep. of Germany ..... 251/129.04

*Primary Examiner*—William E. Wayner
*Attorney, Agent, or Firm*—Gregg I. Anderson

[57] ABSTRACT

An electronic water faucet is disclosed, including means for detecting the presence of an object near an outlet of said faucet and determining whether or not noise or reflected light is being sensed. The faucet includes a swivelable spout relative to a main body. Position sensing means for sensing the angular position of the spout are included. The angular positions which the spout can assume are designed to various zones, and those zones are programmed to be active or not active in an automatic mode of operation of the faucet. A rotary mixing valve for supplying and mixing hot and cold water using a cam and deformable seal is used to partially seal hot and cold water inlets.

26 Claims, 14 Drawing Sheets

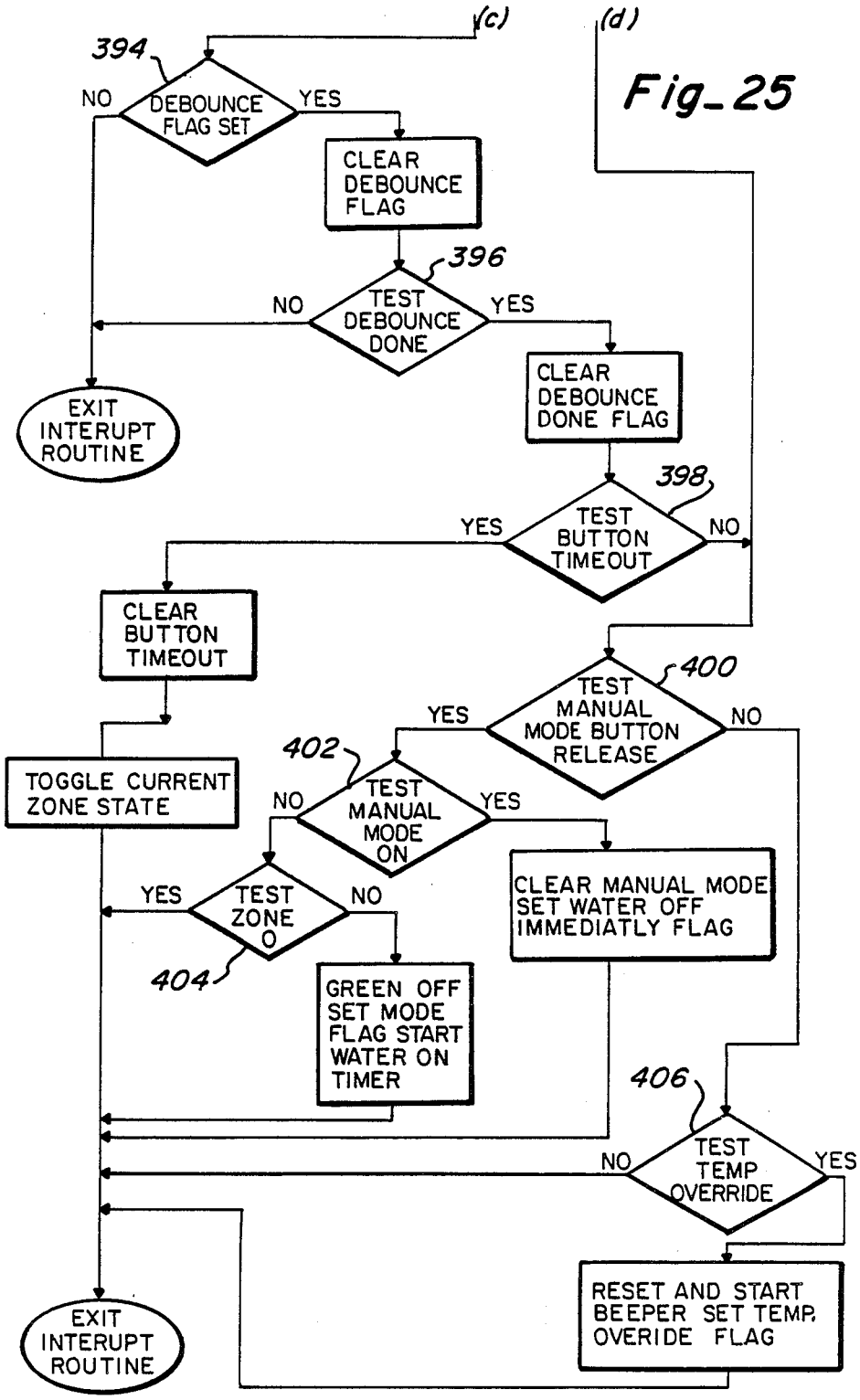
(c)
(d)
Fig_25
394
DEBOUNCE FLAG SET
NO
YES
CLEAR DEBOUNCE FLAG
396
TEST DEBOUNCE DONE
NO
YES
EXIT INTERUPT ROUTINE
CLEAR DEBOUNCE DONE FLAG
398
TEST BUTTON TIMEOUT
YES
NO
CLEAR BUTTON TIMEOUT
400
TEST MANUAL MODE BUTTON RELEASE
YES
NO
402
TEST MANUAL MODE ON
NO
YES
TOGGLE CURRENT ZONE STATE
TEST ZONE 0
YES
NO
404
CLEAR MANUAL MODE SET WATER OFF IMMEDIATLY FLAG
GREEN OFF SET MODE FLAG START WATER ON TIMER
406
TEST TEMP OVERRIDE
NO
YES
RESET AND START BEEPER SET TEMP. OVERIDE FLAG
EXIT INTERUPT ROUTINE

ELECTRONIC FAUCET WITH SPOUT POSITION SENSING MEANS

CROSS REFERENCE TO RELATED APPLICATION

This application is a continuation-in-part of U.S. Pat. application Ser. No. 837,409 for Modular Water Faucet With Automatic Water Supply System, filed Mar. 7, 1986 now U.S. Pat. No. 4,735,357.

BACKGROUND OF THE INVENTION

1. Field of the Invention

The present invention relates to water faucets for use in lavoratories and kitchens of businesses and residences. More particularly, the present invention relates to water faucets which include an automatic control system for sensing the presence of an object, such as the human body, or a portion thereof, near the faucet and for starting or stopping the water flow from the water faucet based upon sensing the presence of the object.

2. Description of the Prior Art

In the water faucet of the present invention, an automatic water supply control system operates by sensing the presence of a person's hands. Infrared rays are emitted from the area of a water outlet, reflected and senced in the vicinity of the outlet of the spout to activate the water faucet, turning it on, and off under certain defined conditions.

M. Ichimori, et al. (U.S. Pat. No. 3,406,941) discloses a water flow control system, which detects capacitance rather than reflected infrared light to initiate water flow. Another automatic water flow control system for a water faucet is seen in M. Teshima (U.S. Pat. No. 3,151,340). A time delay circuit is added to an automatic water supply control system in T. Ishikawa (U.S. Pat. No. 3,575,640). Other automatic water supply or flushing systems are seen in T. Tanaka (U.S. Pat. No. 3,588,038) and C. Atkins, et al. (U.S. Pat. No. 3,314,081).

Other touch responsive and sensing apparatus are seen in C. Atkins, et al. (U.S. Pat. No. 3,254,313); D. Elam (U.S. Pat. No. 2,922,880) and C. Atkins, et al. (U.S. Pat. No. 3,081,594). A switch activated hand washing device is seen in J. Lesher, et at. (U.S. Pat. No. 3,358,747).

Commercially available automatic water control systems have additional features not shown in the prior art patents referenced above. Infrared light activated faucets are known, through such faucets do not have means for differentiating stray or ambient light and therefore can turn on when no one is near the water outlet. It is known to have a switch for overriding the infrared automatic control system to supply a continuous water flow. In case of power failure, a manual bypass system providing for manual operation of the valve of an automatic faucet is also known.

Some conventional water supply systems also include an antiscald feature, which will prevent water above a certain predetermined temperature from flowing. In such faucets, high temperature water is not available when the supply temperature is in excess of the predetermined temperature under any conditions.

A swivelable spout, which will rotate relative to a main body of water faucet is well-known in the prior art, with or without automatic control systems. However, such a swivelable spout which is programmed to not operate in an automatic mode when in certain angular positions, or zones of rotational movement, has not heretofore been known.

Mixing of hot and cold water to the desired temperature of water at the outlet of a water faucet in an automatic water faucet is important to the overall operation.

A hand held spray wash, or vegetable sprayer, is known in the prior art. Spray washes are fed through a water supply line downstream of the valve where mixing takes place. A diverter valve in the water supply line directs mixed water to the spray wash. Use of line pressure and bleeding mixed water off of a water supply line prior to reaching the on-off valve of the water faucet has not been shown or suggested in the prior art.

OBJECTS AND SUMMARY OF THE INVENTION

It is a principle object of the present invention to provide an automatic or electronic water faucet having a swivelable spout movable throughout a range of angular positions where the water faucet is selectively programmable not to operate in an automatic mode when the spout is in certain zones within the angular positions assumable by the spout.

It is a related object of the present invention to provide an automatic water faucet having a swivelable spout selectively programmable to operate in an automatic mode when the spout is inserted into zones and to operate in a manual mode in those zones when the automatic mode is disabled.

It is another object of the present invention to provide an automatic water fuacet having a rotary mixing valve for mixing hot and cold water to a desired water supply temperature.

It is a further object of the present invention to provide an automatic water faucet having a spray wash operative on water supply line pressure bled off of a line between the mixing valve and a water flow control valve.

In accordance with the objects of the invention, an electronic water faucet includes a body to which a spout is swivelably connected. The hot and cold water lines admit water to a rotary mixing valve from where water is directed to an insert body mounted within the body portion of the water faucet. A water flow control valve permits water to exit the body and flow along a spout water channel to an outlet or aerater of the spout. The water flow control valve, as mounted within the insert body of the water faucet, is controlled by a programmable microprocessor.

The electronic water faucet senses, and responds in a predetermined way, to three distinct physical conditions during the course of its operation. The first condition is whether or not an object, usually a human hand, is near the outlet of the spout. An emitter periodically transmits a signal which will be reflected off an object near the outlet if such an object is present. A sensor, which is on only when the emitter is on, reads the signal. In order to help ensure that a reflected signal received at the sensor is not the result of noise or other ambient conditions, the sensing of the reflected signal must occur a majority of the time in a predetermined number of emitter pulses transmitted.

A second condition which the electronic water faucet of the invention senses and which is then implemented in the operation of the water faucet is the angular position of the spout. The spout swivels with respect to the body through an arc. The arc is divided into an off zone, which is to the rear of the water faucet and behind any sink with which the water faucet would be associated, and a predetermined number of zones over the sink. When installed by a user, all of the predetermined number of zones are operational in the automatic mode previously described. The presence of sink dams, unusual sink configurations, and the like, make it desirable that the water faucet not be operative in the automatic mode in certain angular positions the spout may assume.

Whether or not the water faucet operates in the automatic mode in a given zone is determined by the user of the water faucet, and the configuration of the sink. When the faucet, is in a zone which has been designated as one in which the automatic mode is not enabled, a manual push-button activation of the water faucet is the only means by which the water flow control valve can be opened and the water faucet operated.

The third condition which is sensed by the electronic water faucet is the temperature of the water in the spout water channel. If the water temperature is greater than a predefined maximum water temperature, visual and audio warning indications are given. In the basic automatic mode, water will not flow. This can be overriden by a manual input through the push-button by holding it beyond a preselected period of time. In the override mode, a time delay and audio/visual warning are initiated before the water flow control valve is activated. The time delay is sufficient so that the user can get his hands out of the way if the temperature of the water selected is not what was desired. After a set period of time, the faucet will revert to the basic automatic mode. In the manual mode, the water will flow if the push-button is depressed and released.

The mixing valve is of rotary construction and is mounted below counter top level on which the electronic water faucet is mounted. A laterally-moving handle is connected to a torque tube which extends below the counter top and connects to a rotary cam. Rotation of the cam changes the extent to which a deformable seal blocks cold and hot water input passageways. The more the cold water passageway is blocked, the more hot water is emitted to a mixed water passageway leading to the insert body and the water flow control valve contained therein. The single rotary cam, therefore, controls both the hot and cold water input passageways to the electronic water faucet.

A hand spray wash is provided, which is operable on the water pressure in the mixed water passageway, without the need for a mechanical diverter. A standpipe projects above the maximum height water can fill the sink associated with the water faucet, the standpipe projecting into a cavity formed in the insert body of the water faucet. The standpipe helps provide back flow protection, as does venting of the cavity to atmospheric pressure.

DESCRIPTION OF THE DRAWINGS

FIGS. 22–25 are a flow chart of an interrupt program routine for the invention shown in FIG. 1.

DESCRIPTION OF THE PREFERRED EMBODIMENT

Figure 1:
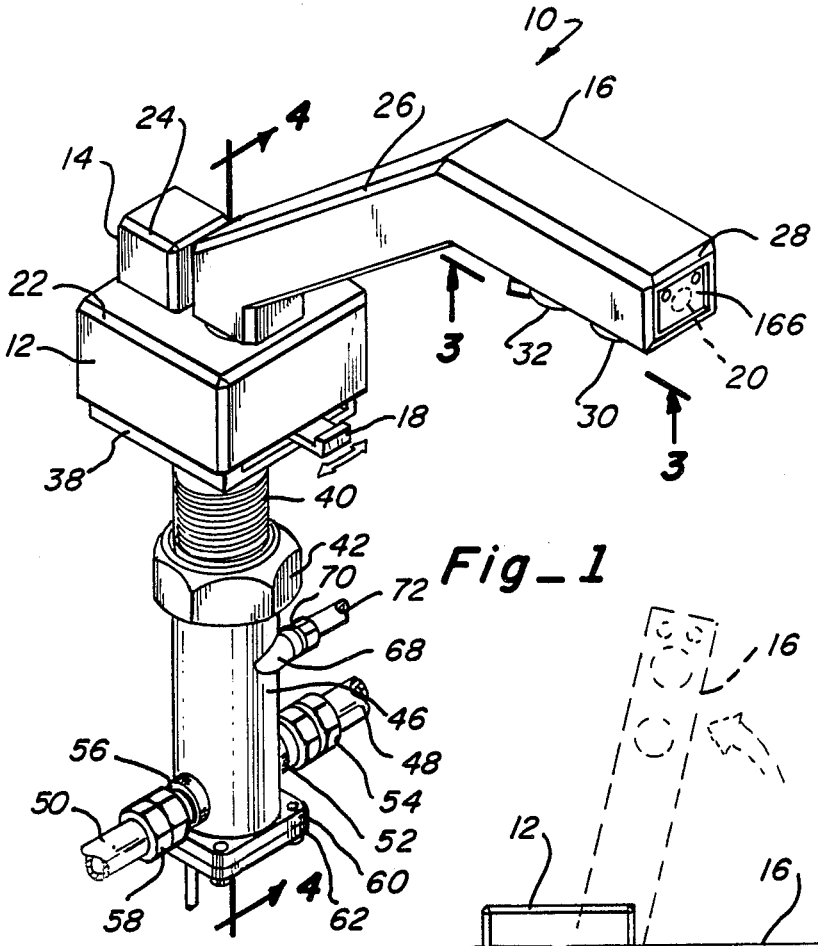
FIG. 1 is a perspective view of an electronic water faucet of the present invention.

An electronic water faucet 10 is seen in FIGS. 1–4 to include a box-like outer body 12 swivelably connected by a spout connector 108 to a spout 16. Cold and hot water lines 48 and 50, respectively, are received by a water inlet pipe 46 threadably connected by a coupling nut 42 to an outer pipe 40 integrally formed with a flanged base plate 38. The base plate 38 rests on a sink or counter top 37 and connects to the outer body 12. A drain stop control handle 14 is mounted on the outer body 12 in a manner as described in co-pending application Ser. No. 837,409 of which this application is a continuation in part and the disclosure of which is incorporated herein by reference. The handle 14 raises and lowers a drain plug rod 82 connected to th drain plug (not shown).

The amount of water entering the inlet pipe 46 from the cold water line 48 and hot water line 50 is controlled by a mixing valve 77. A slide control handle 18 of the mixing valve turns torque tube 66 to adjust the extent to which hot or cold water is admitted to the electronic water faucet 10. A spray wash line 72 allows the water in the inlet pipe 46 to be directed to a handheld spray wash (not shown).

Water flows along a mixed water passageway 102 of the torque tube 66 to a valve operated by a solenoid mounted within insert body 64. The insert body 64 is mounted within the body 12 and contains the valve, solenoid, diaphragm and other mechanical water flow control components not shown in the present disclosure, hereinafter referred to generally as the water flow control valve. Water exits the insert body 64 at outlet 106, flows around the spout connector 108 up connector water passageway 144 and into spout water channel 146 formed in the spout 16. Water flows past a flow restrictor 148, manually actuated by flow control knob 32, to an outlet nozzle or aerator 30 where water is discharged for use.

The electronic water faucet 10 operates in an automatic mode and in a manual mode. In the basic automatic mode, detection means for sensing an object includes an infrared emitter 34 (FIGS. 3, 4, 8 and 17) which transmits an infrared light signal every 50 msecs. If an object, such as a human hand, is near the outlet 30, reflected light transmitted by the emitter 34 is received by infrared sensor 36, which is read by a microprocessor 170 only when the emitter 34 is pulsing. A circular buffer in RAM is the means for receiving and storing reflected signals received by the sensor 36 in the present invention, in part, to avoid turning on the water flow control valve as a result of reflected light or electronic noise.

Figure 2:
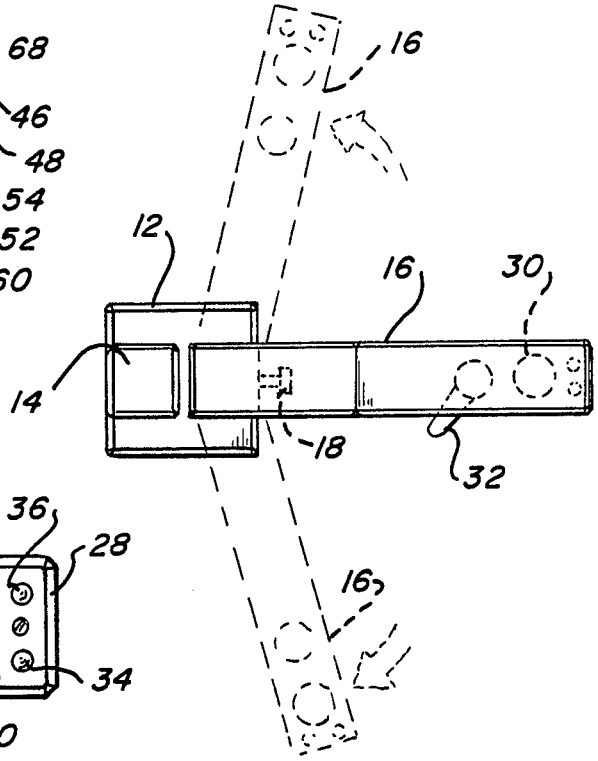
FIG. 2 is a top plan view of the invention shown in FIG. 1, a spout of the water faucet being shown in phantom line in various angular positions relative to a body of the faucet.

As seen in FIG. 2, the spout 16 swivels through an arc to assume various angular positions with respect to a sink (not shown) over which the electronic water faucet 10 is mounted. (FIG. 2). Position sensing means for enabling or disabling the detection means, dependent upon the angular position or zone of the spout 16, is shown in FIGS. 9–11 and 16. Three superimposed spout position emitters 116 transmit signals which are reflected off of a coded graph 120 (FIG. 11) to a spout position sensor 118. Depending on the position of the spout, which moves the zone or position emitter 116 and position sensor 118, the stationary graph 120 will dictate a three bit code which is inputted through the microprocessor 170, which stores a main program routine (FIGS. 18–21) and an interrupt program routine (FIGS. 22–25). Depending upon the zone in which the spout 16 is located, the water faucet 10 will or will not operate in the automatic mode. This allows the user to prevent the automatic mode from operating when the faucet is left over a sink dam, for example. In the preferred embodiment, a O zone disables the automatic mode for any position rearward of the sink and for 15° of arc either side thereof.

The remaining angular positions assumable by the spout 16 will be over the sink area. These angular positions are designated, in the preferred embodiment, into seven zones corresponding to columns 128, 130, 132, 134, 136, 138, and 139 on the graph 120 of FIG. 11.

Figure 15:
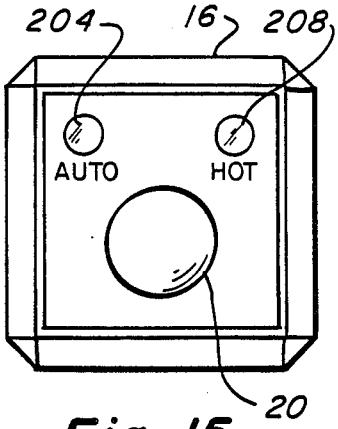
FIG. 15 is a front view of the high temperature cut-out over-ride button

In association with operation of the water faucet 10, a water temperature sensor 162 (FIGS. 4, 8, and 17) measures the temperature in the spout water channel 146 and compares it to a predetermined value. If the water temperature is greater than a predetermined value and the water faucet is operating in the basic automatic mode, water will not flow. If the over-temperature condition is overriden by depressing push-botton 20 for more than 2 secs. but less than 6 secs., piezo electric beeper 212 emits two beeps and red LED 208 (FIG. 15) flashes, and after a time delay of 0.7 secs., water will flow in the override automatic mode.

If the water temperature exceeds the preset maximum temperature, the water faucet 10 can be operated in the manual mode by pushing and releasing the push-button 20 at the tip of the spout. In the manual mode, the red LED will continue to flash. As a result of the foregoing, hot water will be available only when the user has been fully warned by the beeper 212 and the flashing red LED 208 and, therefore, wants hot water.

Figure 3:
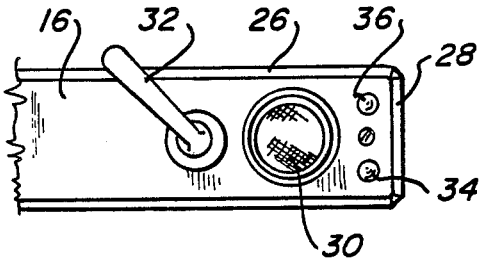
FIG. 3 is a fragmentary bottom plan view of an outlet of the spout.

As seen in FIG. 1, the water faucet 10 is of generally cubic design, including a body chamfer 22 associated with the body 12, a stopper chamfer 24 associated with the stopper handle 14, a spout chamfer 26 associated with the spout 16 and a tip chamfer 28. This cubic design allows for advantageous location of the manual button 20 at the tip of the Spout 16, and easy access to and use of the flow control knob 32 (FIG. 3).

Figures 4, 5, 6:
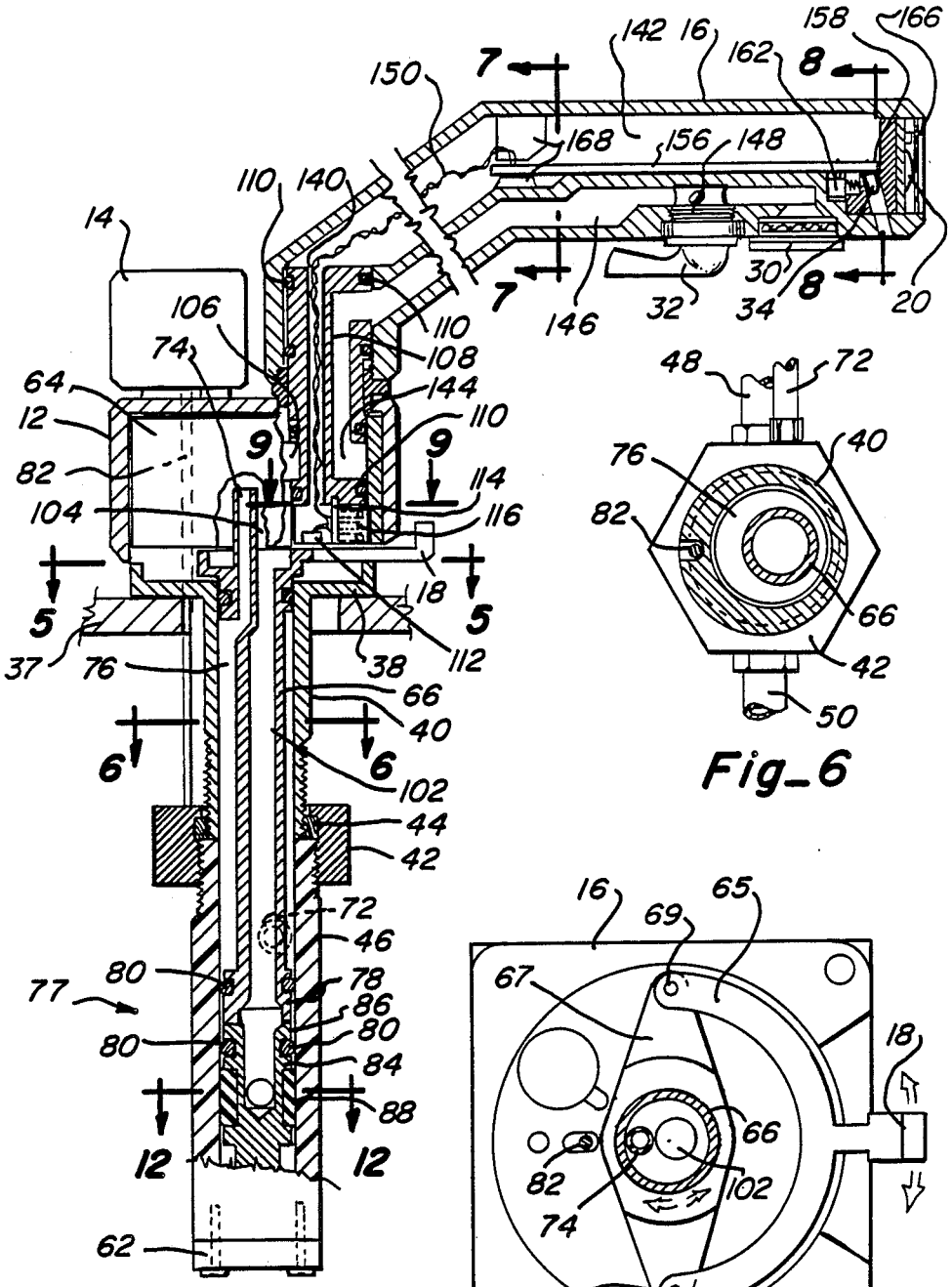
FIG. 4 is a sectional view taken in the plane of line 4—4 of FIG. 1.
FIG. 5 is a sectional view taken in the plane of line 5—5 of FIG. 4.
FIG. 6 is a sectional view taken in the plane of line 6—6 of FIG. 4.
Figure 7:
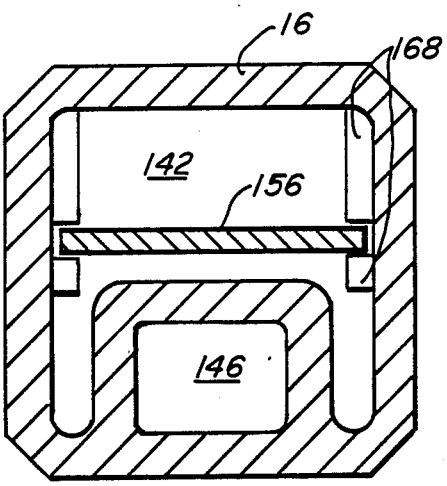
FIG. 7 is a sectional view taken in the plane of line 7—7 of FIG. 4.

The mixing valve 77 will now be described in detail. A seal 44 maintains a water-tight connection between the inlet pipe 46 and the outer pipe 40 at the coupling nut 42. The interior of the outer pipe 40 and inlet pipe 46 receives the torque tube 66, which tube is turned by the slide control handld 18. The handle 18 is connected through a yolk 65 to a lever 57 at pin connections 69. The lever 67 is frictionally or otherwise fit about the exterior of the torque tube 66 so that lateral movement of the handle 18 pivots the torque tube. The torque tube 66 extends downwardly along the interior of the outer pipe 40 and inlet pipe 46 terminating in a fork 78 which mates to a complementary fork 86 of cam 84 (FIG. 4). Both the torque tube 66 and the cam 84 are preferably formed of rigid plastic. O-ring seals 80 are provided to seal the lower part of the inlet pipe 46 from water.

Figure 12:
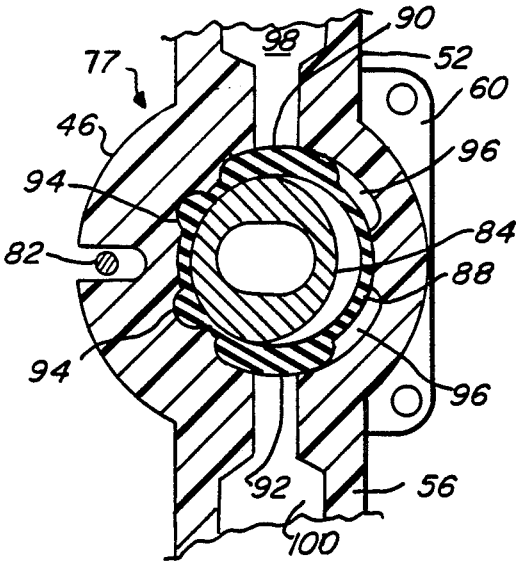
FIG. 12 is a fragmentary sectional view taken in the plane of line 12—12 of FIG. 4 showing a rotary mixing valve of the invention shown in FIG. 1.
Figure 13:
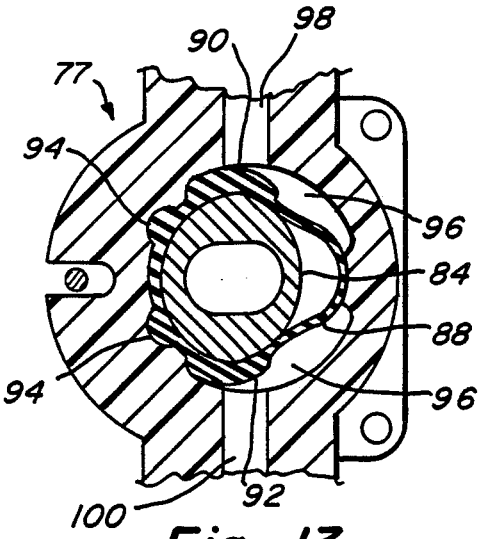
FIG. 13 is a sectional view similar to FIG. 12 with a deformable seal of the mixing valve deformed under the influence of water pressure from hot and cold water lines.

A deformable seal 88 of the mixing valve 77 is held in stationary position within the inlet pipe 46 by location slots 94 extending vertically along the interior of the inlet pipe 46. The deformable seal 88 is seen in FIG. 12 in an at rest position where no water is flowing in cold water input passageway 98 or hot water input passageway 100. Once water pressure is applied from cold water line 48 and hot water line 50, cold water seal 90 and hot water seal 92 of the deformable seal 88 deflect and permit water to enter mixed water input passageway 96 formed interiorly of the inlet pipe 46. (FIG. 13). In a negative pressure situation in the hot and cold lines, seals 90 and 92 close off input passageways 98 and 100. This prevents cross-flow and helps prevent back flow from siphoning water through the spray wash.

Figure 14:
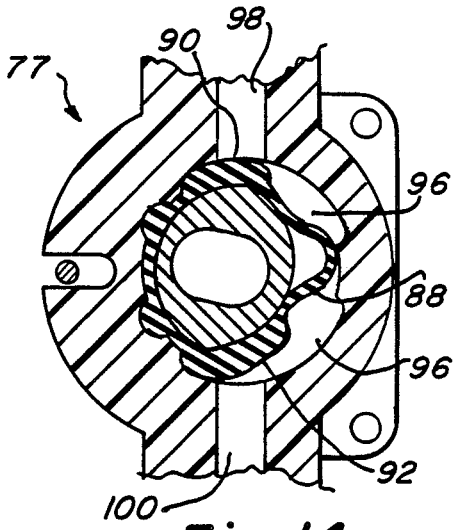
FIG. 14 is a sectional view similar to FIG. 13, a rotary cam of the mixing valve rotated to permit more deflection of the deformable seal relative to a hot water input passageway.

Turning the handle 18 rotates the cam 84 restricting the flow of cold water by closing off the cold water input passageway 98 with the cold water seal 90, while simultaneously opening the hot water input passageway 100 and permitting the hot water seal 92 to deflect more under the water pressure therein. (FIG. 14). The resultant mixed water in the mixed water imput passageway 96 is relatively hot. Turning the handle the opposite direction will close the hot water input passageway 100 and supply relatively cold water to the water flow control valve.

Water flow is seen to initiate at the cold water line 48 and hot water line 50. The inlet pipe 46 includes a cold water receiving nipple 52 and a hot water receiving nipple 56 which are connected to the hot and cold water lines 48 and 50, respectively, by a cold water line connector 54 and a hot water line connector 58. The bottom of the inlet pipe 46 terminates in an end flange 60 which is sealed shut by an end plate 62. Water is thus directed upwardly through the mixed water input passageway 96 into the mixed water passageway 102 which directs the water to an inlet 104 of the insert body 64. Opening or closing the water flow control valve (not shown) allows water to leave the insert body by way of the outlet 106. From the outlet 106, water is directed, as has previously been described, to the outlet nozzle 30. It is noted that the flow control knob 32 is manually adjustable to fully open or partially close the spout water channel 146 by means of the flow restrictor 148.

The mixed water, under line pressure, is available for use in the spray wash, exiting the inlet pipe 46 by spray wash nipple 68, which is coupled by connector 70 to a spray wash line 72. Reverse water flow from the spray wash into the water faucet 10 is prevented along spray wash passageway 76 by the seals 90 and 92. Backflow is further prevented by extending standpipe 74 into the water-filled cavity in the insert body 64. The cavity (not shown) is vented to atmosphere through the diaphragm of the water flow control valve in the case where negative pressure is applied. Under low water pressure, the diaphragm opens to vent to atmosphere. In addition, the standpipe 74 extends one inch above the highest level water might attain in the sink associated with the water faucet 10. These two features, in combination, prevent negative pressure from causing back flow of water from the spray wash.

The spout position sensing means will now be described. In the circuit diagram of FIG. 16, it is seen that there are three spout position emitters 116 and three spout position sensors 118. The postion sensors 118 output is inputted to the microprocessor 170 along conductors 150. The output is in the form of a high or a low signal, depending upon the angular position of the spout 16, which corresponds to the zones 128, 130, 132, 134, 136, 138 or 139 of the coded graph 120. As will be discussed hereinafter, depending upon the coded input to the microprocessor, the program of the present invention will either enable or disable operation of the water faucet 10 in the automatic mode. The coded input is in turn dependent upon the angular position of the spout.

A bore 140 of the spout connector 108 carries spout position sensor conductors 150 from a mounting board 114 on which the position emitters 116 and position sensors 118 are mounted to circuit board 156 mounted between circuit board locaters 168 in the spout 16. The mounting board 114 is securely connected to the spout connector 108. The position sensors 118 and the position emitters 116 are secured to the mounting board. Power is supplied to the position emitters through solenoid plug 112, which plug 112 also operatively connects to the solenoid (FIG. 4).

Figure 9:
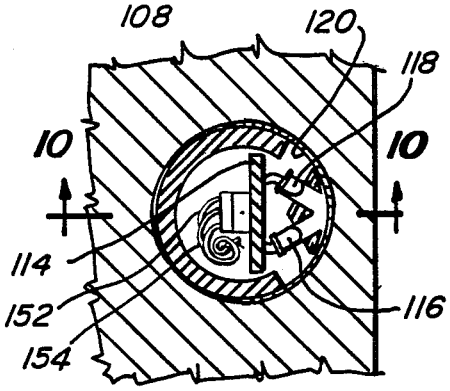
FIG. 9 is a fragmentary sectional view taken in the plane of line 9—9 of FIG. 4.
Figure 10:
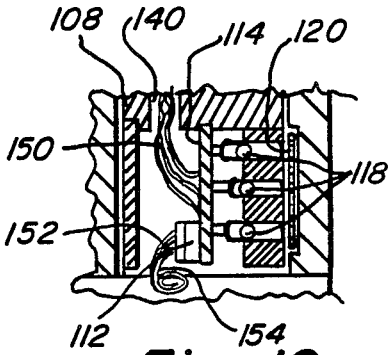
FIG. 10 is a fragmentary sectional view taken in the plane of line 10—10 of FIG. 9.
Figure 11:
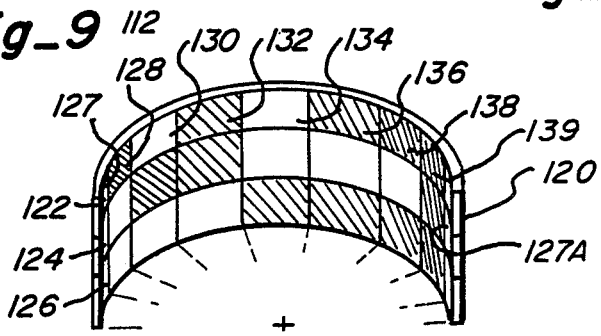
FIG. 11 is a perspective view of a coded graph, which code is read and inputted through a microprocessor of the invention to determine the angular position of the spout with respect to predetermined zones.

The physical operation of the spout position sensing means is best seen in FIGS. 9–11. As seen in FIG. 9, the position emitter 116 transmits a signal which is reflected off of the coded graph 120 to the position sensor 18. A position emitter and position sensor pair are associated with each of a top row 122, a middle row 124 and a bottom row 126 of the coded graph 120. (FIG. 11).

As the spout connector 108 and connected spout 16 are rotated, the mounting board 114 and superimposed position emitters 116 and position sensors 118 are likewise rotated. The coded graph 120 is stationary with respect to the body 12. Thus, the position of the spout will correspond with a specific code associated with a specific zone, as defined on the coded graph 120. The graph 120 includes reflective and nonreflective areas, reflective areas being darkened in FIG. 11. A reflective area generates a high or 1 signal. For example, if the spout 16 is in the third zone 132, the emitter/sensor pair associated with row 122 generate a 1, the emitter/sensor pair associated with row 124 generate a 1, and the emitter/sensor pair associated with row 126 generate a 0. The binary code generated, 110, is inputted to the microprocessor 170, which is preprogramed to either enable or disable the automatic mode based upon the position of the spout in the third zone 132.

The detection means for sensing an object near the nozzle outlet 30 of the water faucet 10 will be discussed by reference to FIG. 17. The infrared emitter 34 generates an infrared light signal which, if reflected off an object near the nozzle outlet 30, is received by the infrared sensor 36. Power is supplied to the emitter 34 by conductors 160 and the output of the sensor 36 returned to the microprocessor 170 on the circuit board 156 by conductors 158. (FIG. 8).

Figure 8:
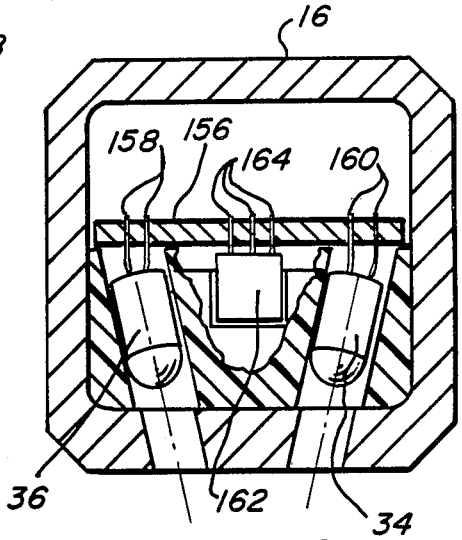
FIG. 8 is a sectional view taken in the plane of line 8—8 of FIG. 4.

As best seen in FIGS. 4 and 8, the emitter 34 and sensor 36 are angled relative to vertical about 15° forward. The emitter 34 and sensor 36 are also angled inwardly toward a vertical plane the same amount, about 15°. This has been found to help minimize problems with detecting or sensing an object near the outlet 30 when water flow is on.

Figure 16:
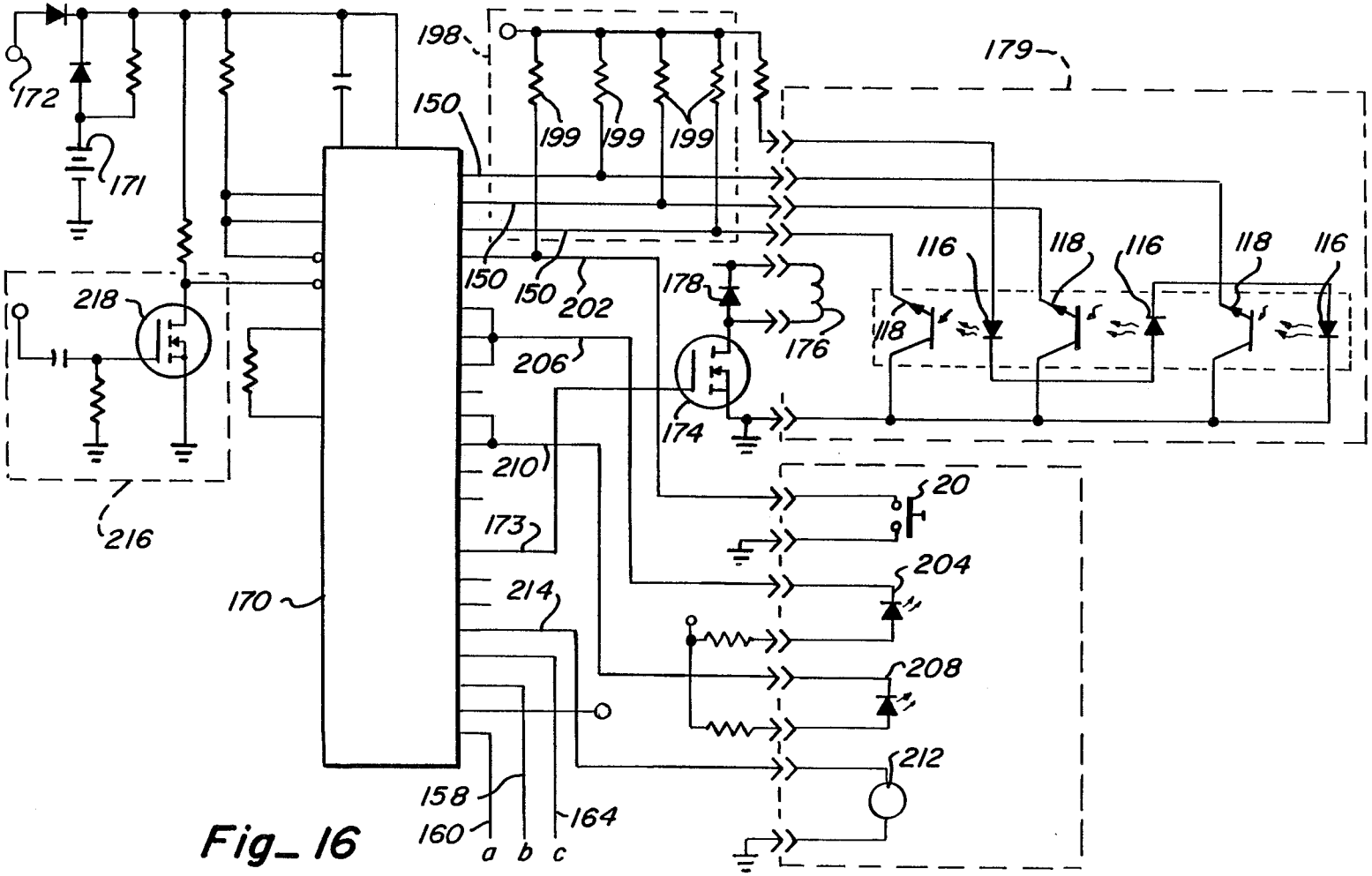
FIGS. 16 and 17 are a circuit diagram of a control circuit of the invention shown in FIG. 1.

Another important aspect of the invention is controlled access to hot water. The water temperature sensor 162 provides an input 245 to comparator 248. (FIG. 17). This input is compared to input 247 established by resistor 246. If the water temperature sensed by water tempeature sensor 162 is in excess of the preselected value set in resistor 246, then water flow can occur only under certain circumstances. In the override automatic mode, after button 20 is held for more than 2 and less than 6 secs., the computer program of the invention enables the "HOT" or red LED 208 and the piezo electric beeper 212 (FIG. 16). The microprocessor 170 enables these elements along conductors 210 and 214, respectively. After a 0.7 sec. delay and two beeps and a flashing of the red LED, hot water will flow. The microprocessor 170 and the program of the present invention contained therein receive information from the button 20 along conductor 202.

The remaining portions of the electrical circuit depicted in FIGS. 16 and 17 will now be discussed. Reset circuitry 216 (FIG. 16) employs a mosfet 218 operable on battery 171 to reset the microprocessor 170 in the event of return of power after a power failure. Primary power is inputted at 172. In that portion of the circuit, the spout position sensing means circuit 179 has already been discussed. The solenoid 176 is powered by a solenoid mosfet 174 which receives power along conductor 173. A spout position sensing backup circuit 198, consisting of a preselected input established by resistors 199, ensures that in the event of failure of the sensing circuit 179, the spout will always operate in the automatic mode. Output conductor 206 activates the green LED 204 to indicate operation in the automatic mode.

Figure 17:
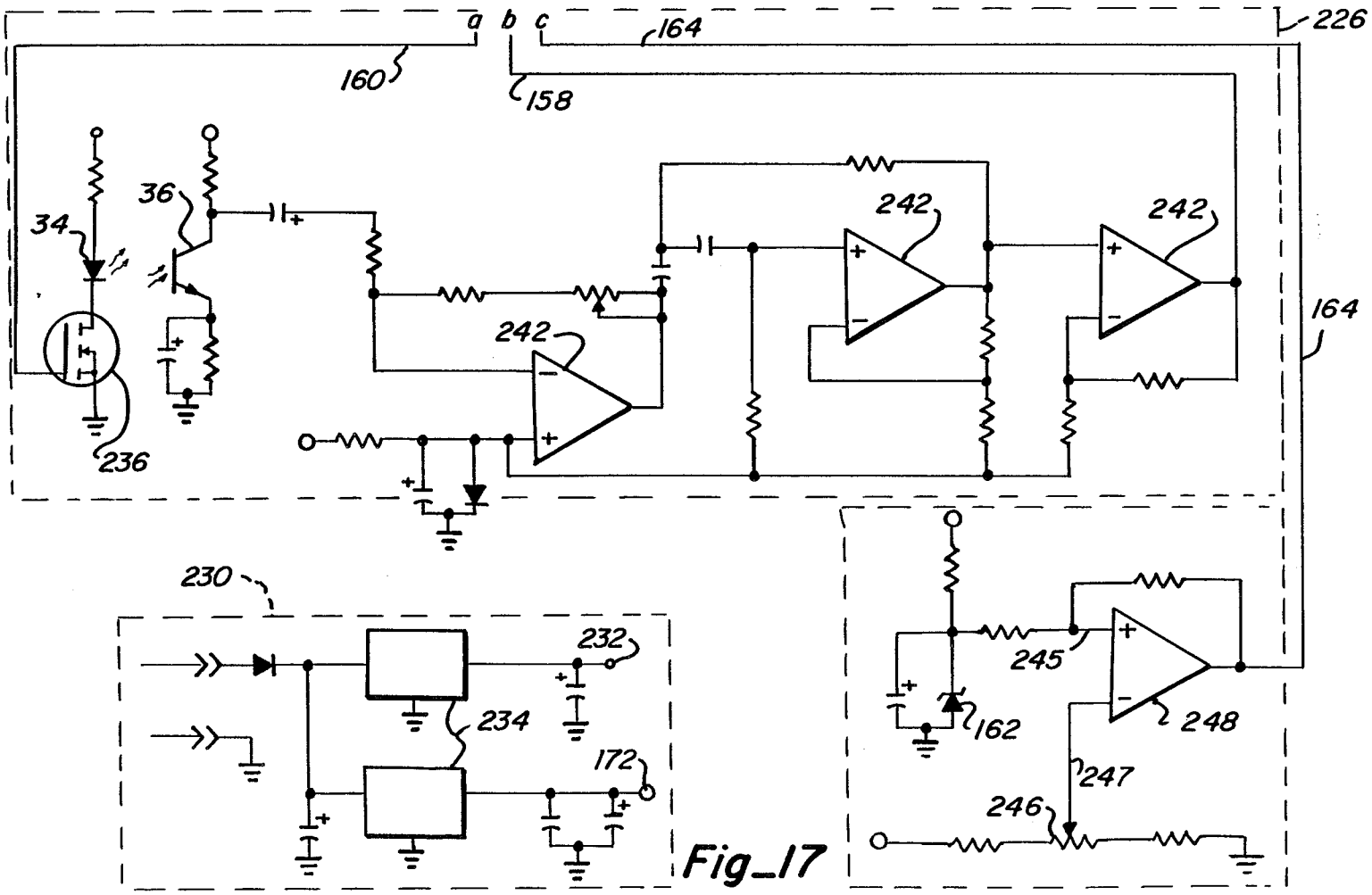

Power is supplied to the water faucet 10 through circuit 230 (FIG. 17). Voltage regulators 234 govern voltage supplied to the emiters at lead 232 and to everything else at lead 172.

The microprocessor 170, through the main program routine (FIGS. 18–21) and the interrupt program routine (FIGS. 22–25), receives the inputs from the sensors and the manual inputs, correlates the information and controls the water flow control valve, the green LED 204, the red LED 208 and the beeper 212. The main program routine includes six sections, initialization, power testing, master water shutoff, spout position zone testing, water temperature sensing and automatic object sensing or detecting. The main program routine only closes the water flow control valve. The interrupt program routine handles timekeeping functions and opens the water flow control valve.

Figure 18:
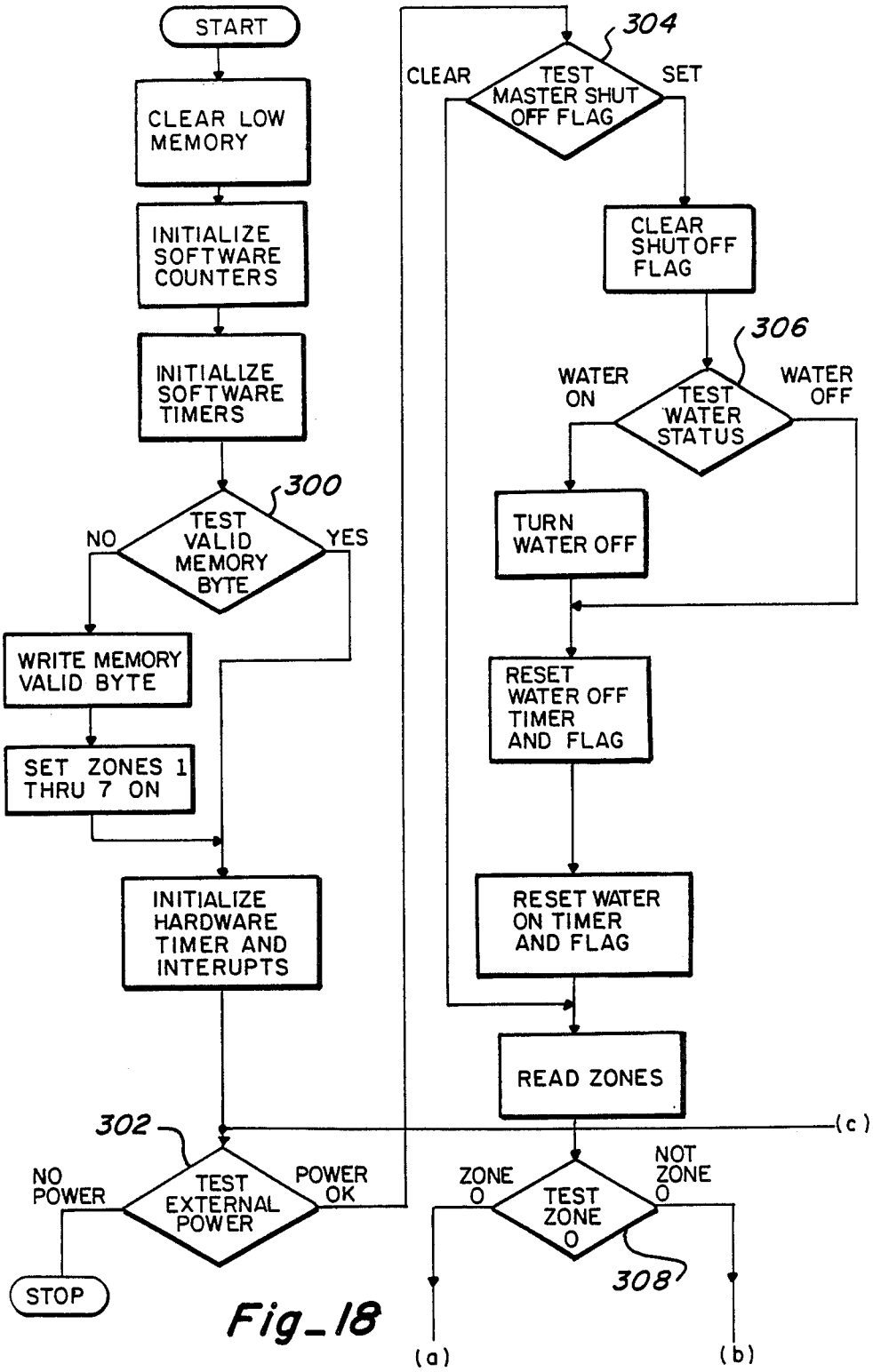
FIGS. 18–21 are a flow chart for a main program routine of the invention shown in FIG. 1.
Figure 19:
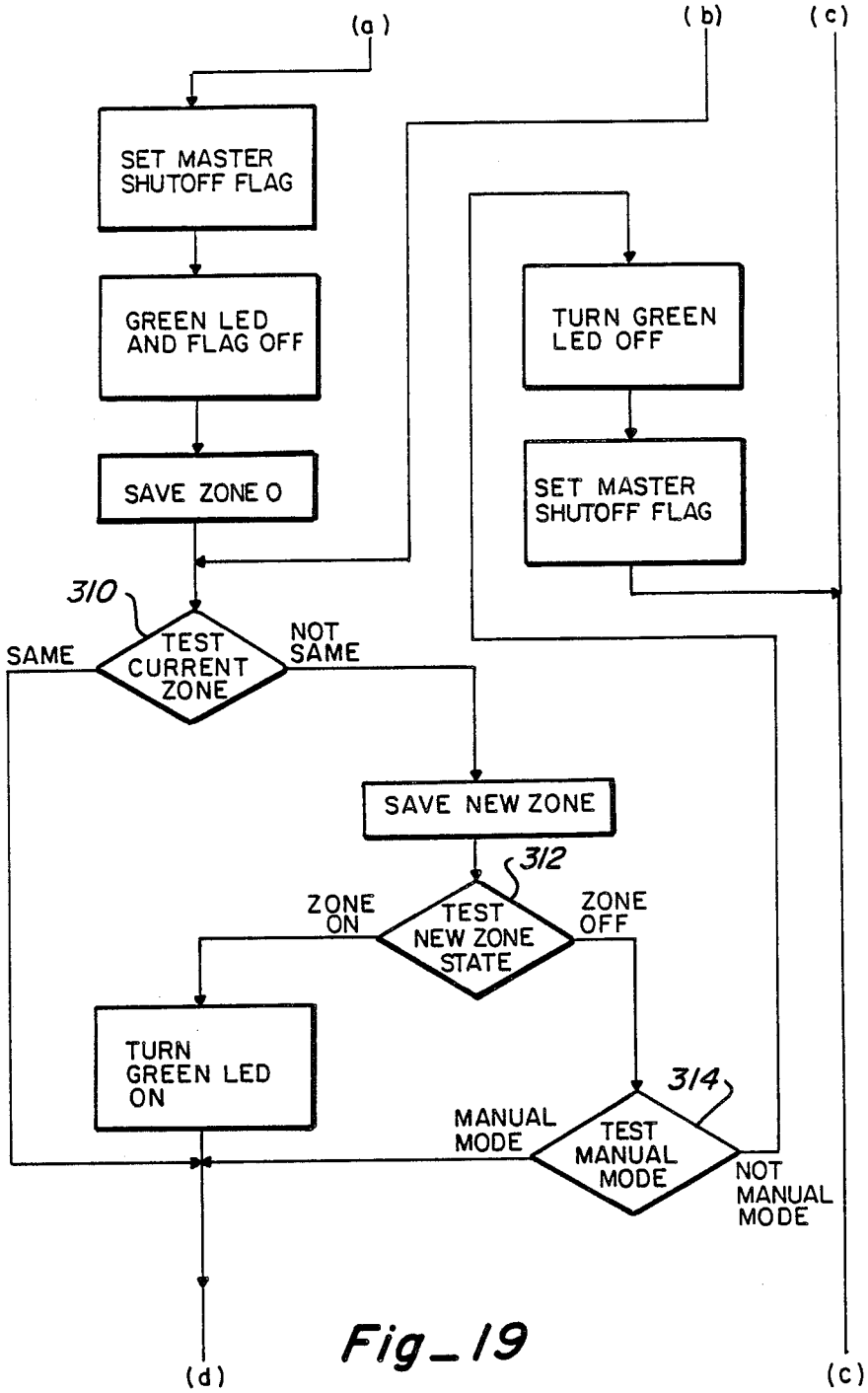

The main program routine initialization process is seen in FIG. 18. At block 300, the initialization section of the main program routine, checks for a preselected, prestored 8 byte word. If the word is present, then the spout position sensing means has been previously programmed and the prior program is still valid. If the word is not present, then a valid word must be written, 01010101 being used, and zones 1 through 7 are set to be on in the automatic mode.

Initialization complete, power testing is done at block 302. If power is ok, then the loop continues; if not, the microprocessor 170 is put in a low power mode. The microprocessor is reset to exit this state by the reset circuit 216. The master shutoff test at block 304 is necessary to turn the water off immediately under conditions such as the presence of the O zone 127 and 127A, automatic mode in a deactivated zone or a switch from manual mode to automatic mode by toggling button 20, for example. If the master shutoff is clear, then the next step is simply to read the zones for spout position sensing. If the master shutoff flag is set, the flag is cleared, and whether water flow is on or off is tested at block 306. Water is forced off and the water off and water on timers and flags are reset. There is a 5 sec. delay before water shuts off in the automatic mode and a 7 sec. delay before water comes on in the automatic mode.

The next section of the main program routine determines what zone the spout 16 is in. Zone O 127 and 127A is tested at block 308. If zone O is not present (FIG. 19), then what zone the spout 16 is in must be determined beginning at block 310. If the spout 16 is in zone O, as determined at block 308, then the master shutoff flag is set in the green LED 204, indicating automatic mode is turned off and zone O is established in the memory of the microprocessor 170.

At block 310, the main program determines whether or not the zone being sensed by the emitters 116 and the sensors 118 continues to be the same as the main program continuously runs. If the sensed zone is not the same, then the new zone is placed into memory, and whether or not the new zone is in automatic mode is determined at block 312. If the zone is on and the new zone is in the automatic mode, then the green LED 204 is turned on. If the new zone is not one in which the automatic mode is permitted, then at block 314 the main program tests whether or not the electronic faucet 10 is in the manual mode as a result of a user selecting manual mode by depressing and relesing the button 20. If the water faucet 10 is still in the automatic mode, but the zone in which the spout is positioned is off, indicating that the automatic mode is disabled, then the green LED 204 is turned off, the master shutoff flag is set and water flow shut off, and a return is made through the loop beginning at the power section.

Figure 20:
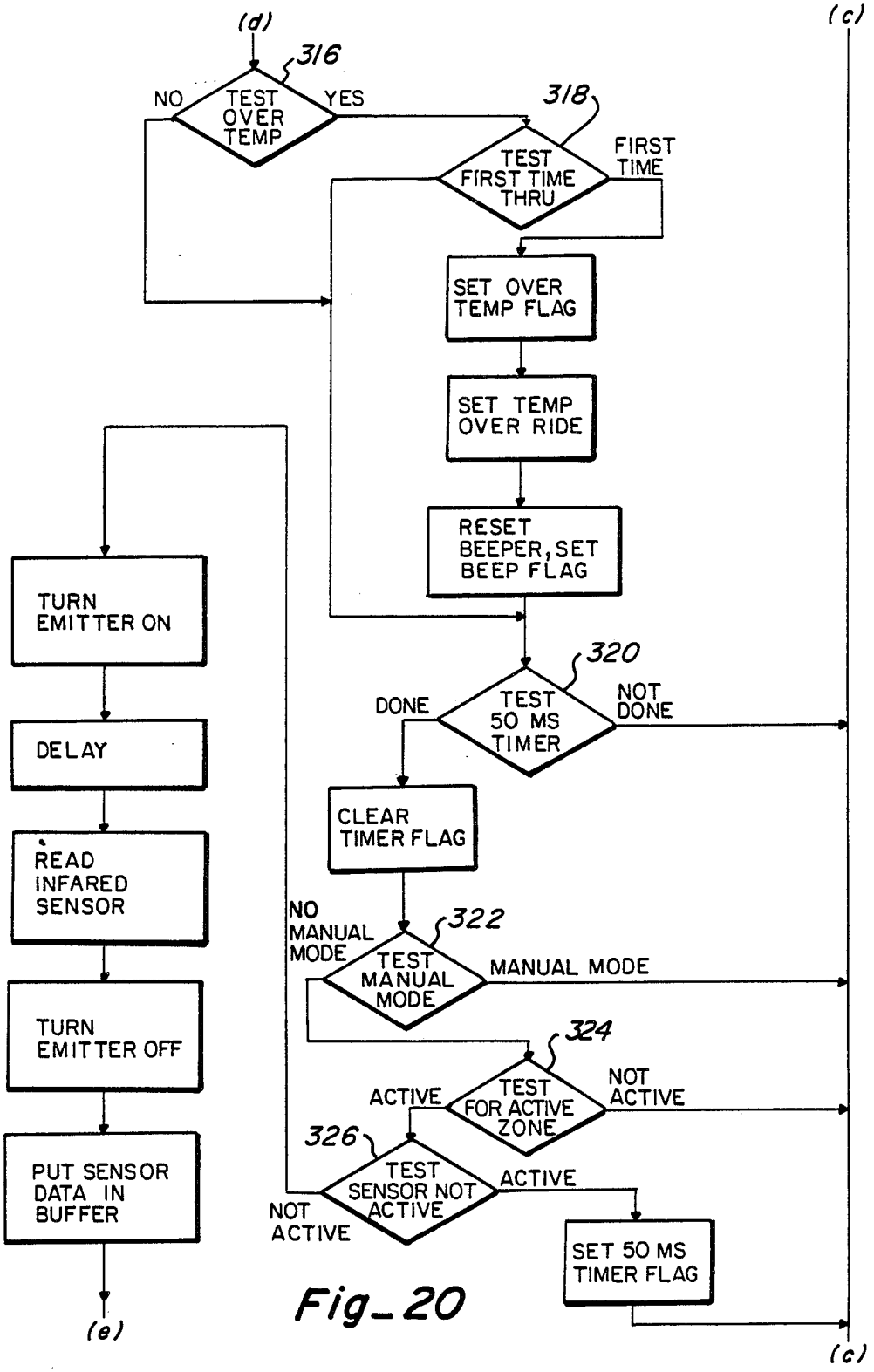

With reference to FIG. 20, at block 316 the main program tests to see whether the water temperature sensor 162 is sensing a temperature greater than the predetermined maximum temperature set by resistor 246. If an over-temperature situation exists, then a test is made at block 318 to establish whether or not this is a new condition. If it is a first time over-temperature or a new condition has been detected, then an over-temperature flag is set and temperature override is set. Once temperature override is set under conditions where water is already flowing, then the mixing valve 77 is operated to increase the temperature of the water to an overtemperature condition. Physically, the beeper 212 beeps twice and the red LED 208 flashes. In the override automatic mode, after the button 20 has been used to select override, hot water will flow after a 0.7 sec. delay, the buzzer beeping twice and the red LED 208 flashing on and off. If there is no over-temperature situation or the over-temperature situation override has been established, then the main program tests at block 320 to determine whether a 50 msec. timer, set by the interrupt program routine, has been completed. If not, then the main program loop is redone until that has occurred. Once done, the timer flag is cleared, and at block 322, a test for manual mode made. If in the manual mode, the main program is not required to do anything. If in the automatic mode, then the zone under consideration is tested at block 324 to determine whether or not it is an active zone, in which automatic mode can function, or a nonactive mode. If the zone is active, then at block 326, whether or not the sensor 36 is on is determined. The sensor 36 does not activate until the emitter 34 is on. If the sensor is active, then the 50 msec. timer flag is set, and the loop of the main program is repeated. If the sensor 34 is not active, then the emitter is turned, a software program delay of 40 to 80 microseconds is implemented, so that the amplifiers 242 can integrate with the pulse of the emitter 34 and the infrared sensor 36 is read. The emitter is then turned off, and the reading of the sensor put in the circular buffer.

Figure 21:
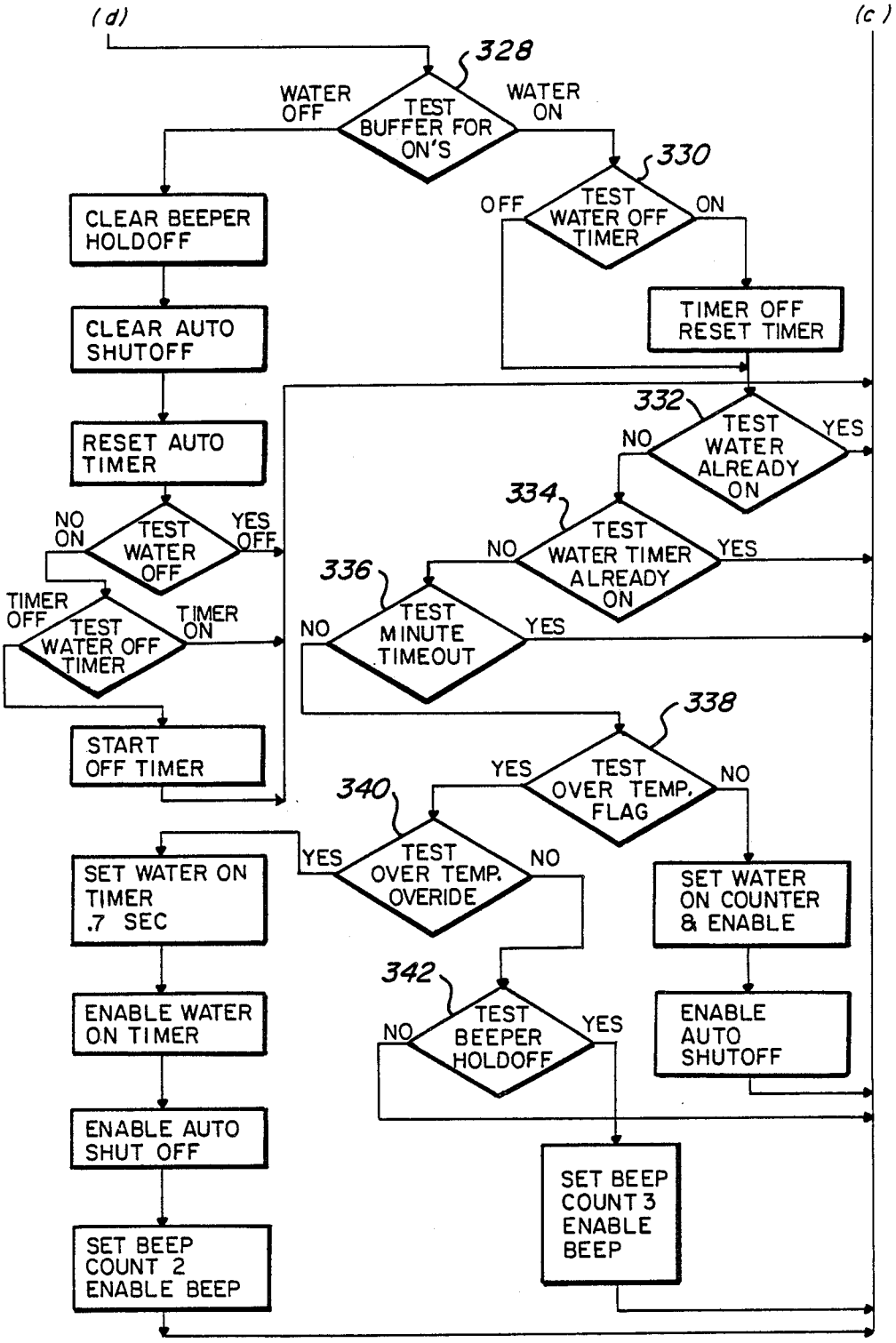

Turning to FIG. 21 of the main program routine, at block 328 the ciruclar buffer, which stores eight consecutive reads of the sensor 36, determines whether at least five of the reads are on to determine that the water is on. If water is on, then at block 330, the main program tests whether or not the water off timer, a delay of 0.5 secs. after water shuts off, is on or off. If it is on, the timer is reset; if off, the main program tests whether or not the water is already on at block 332. If so, then the loop is repeated. Of not, the program tests at block 334 whether the water on timer, a 0.7 sec. delay, is on. If yes, then the program loop is repeated; if not, then at block 336 the main program tests whether or not water has been flowing continuously for one minute at block 336. After one minute of water flow in the automatic mode, the water flow control valve is forced off. As long as the detection means senses an object, water flow stays off. This flag keeps water from flowing until the object is removed and then returned to the area where it is sensed.

At block 338, a test is made as to whether or not the over-temperature flag is set. If not, the water on timer is set, automatic shutoff is enabled, and the loop is repeated. If the over-temperature flag is set, then at block 340 it is determined whether or not the over-temperature override is in effect. If so, water on timer is set for 0.7 secs. and the buzzer 212 enabled for two beeps and the automatic shutoff enabled. If there is no over-temperature condition tested at block 340, then a test is made as to whether or not the beeper hold is off. If not, the main program is repeated. If yes, then three beeps are made on the buzzer 212, and hot water is allowed to flow.

Figure 22:
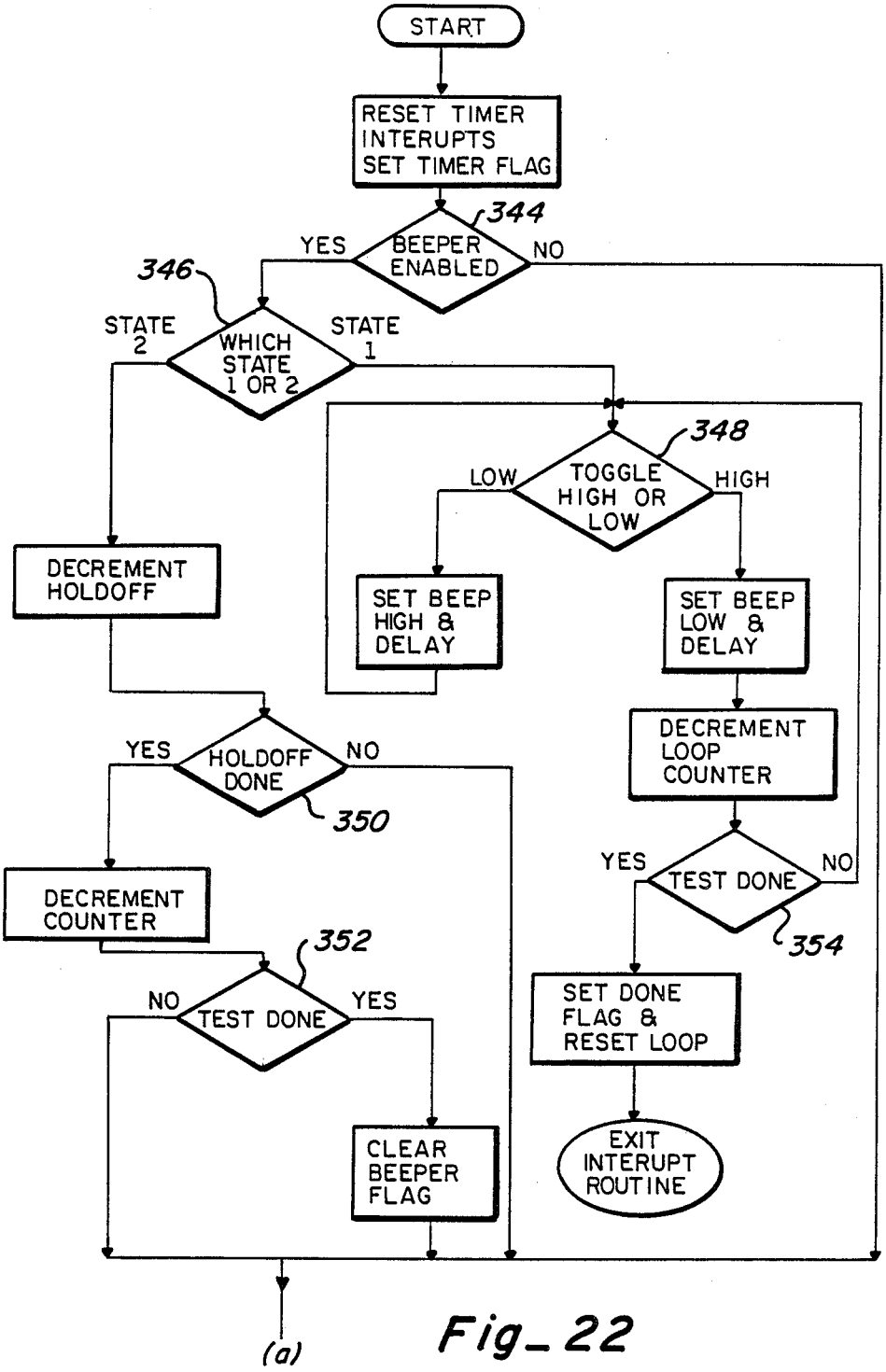

The interrupt program routine is seen in FIGS. 22–25. The interrupt routine runs a complete cycle every 50 msecs. as opposed to the main program which is continuously running without relation to any predetermined time. As seen in FIG. 22, the timer flag is initially set, and at block 344 the beeper tested as to whether it is enabled. Physically, the beeper exists in two states. A 100 msec. pulse defines a state wherein a beep is generated. This is state 1. In state 2, a 100 msec. delay follows the generation of a beep. If the beeper is enabled, then it is determined at block 346 whether or not state 1 or 2 exists.

If state 2 exists, then a delay until the 100 msecs. has passed in implemented. If the 100 msecs. has passed, as determined at block 350, then the number of beeps are counted, and when the correct number of beeps, two or three depending on the mode of operation, has been completed, the beeper flag is cleared, as determined at block 352.

If at block 346 it is determined that state 1 exists, then block 348 forces the beep to high, and the frequency of the beep which is set and the loop counter decremented. At block 354, it is determined whether the loop counter has been decremented, and if so, then the loop is reset and the interrupt routine exitted.

Figure 23:
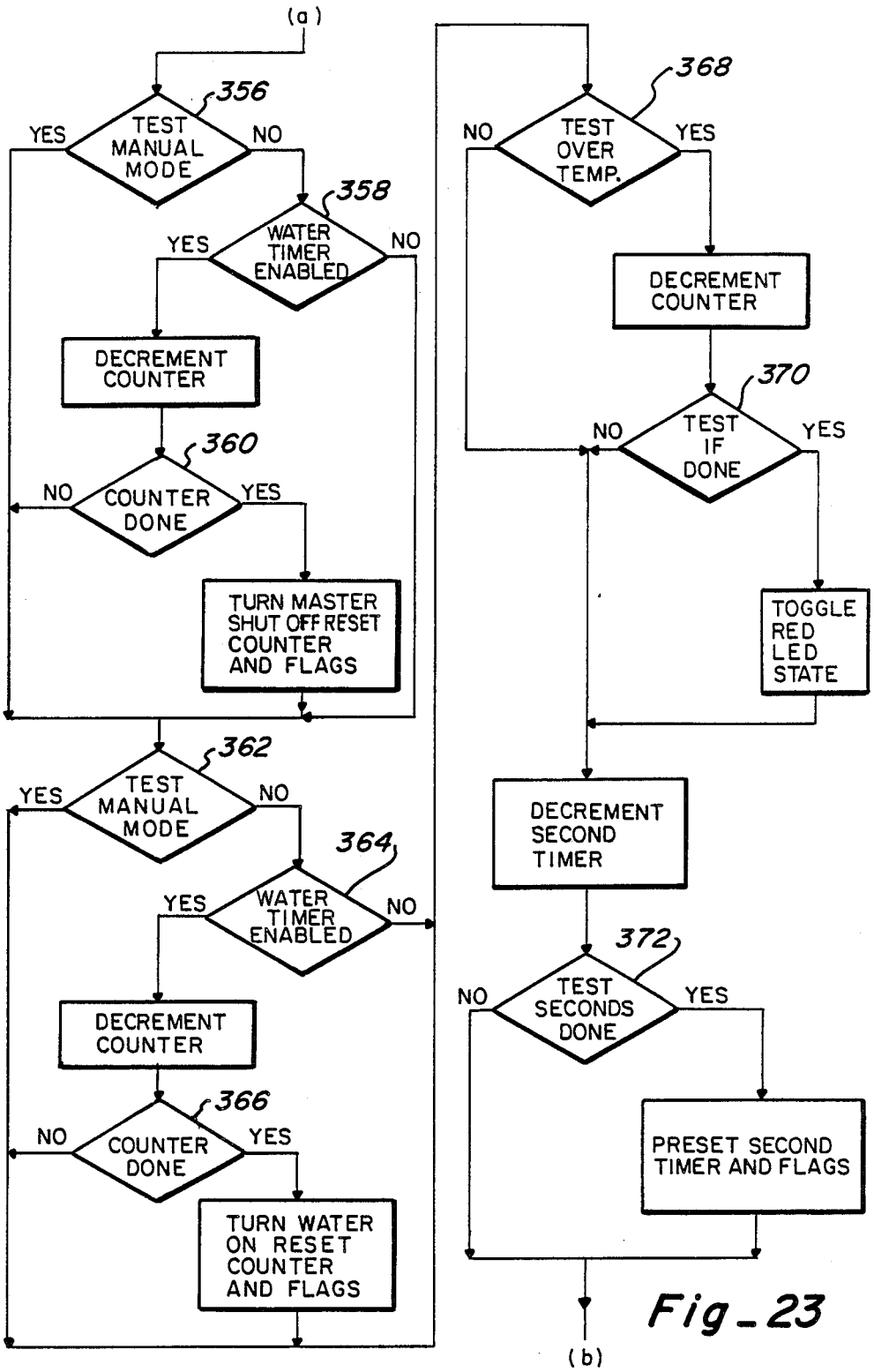

In FIG. 23, the initial portion of the flow chart concerns the water off timer, a 0.5 sec. delay after a hand or other object is removed from the vicinity of the detection means of the electronic water faucet 10. The manual mode is tested at block 356. At block 358, whether or not the water timer is enabled is tested, and if so, it is determined whether or not the 0.5 sec. has passed. If 0.5 sec. has passed, as determined at block 360, the master shutoff is implemented and the counter reset.

The next portion of the flow chart of FIG. 23 relates to the water on timer. Again, the manual mode is determined at block 362. The water timer is enabled at block 364. The counter is decremented, and if the delay after insertion of a hand in the vicinity of the detection means of the water faucet 10 has passed, as determined at block 366, then the water is turned on, and the counter and flags are reset.

The next portion of the flow chart of FIG. 23 concerns the red LED 208. If an over-temperature condition is detected at block 368 and the condition has occurred for more than 20 secs., as determined at block 370, then the red LED is toggled and the second timer decremented. At block 372, the logic again determines whether or not the 20 sec. period has passed, and if so, the timer is reset and flags reset.

Figure 24:
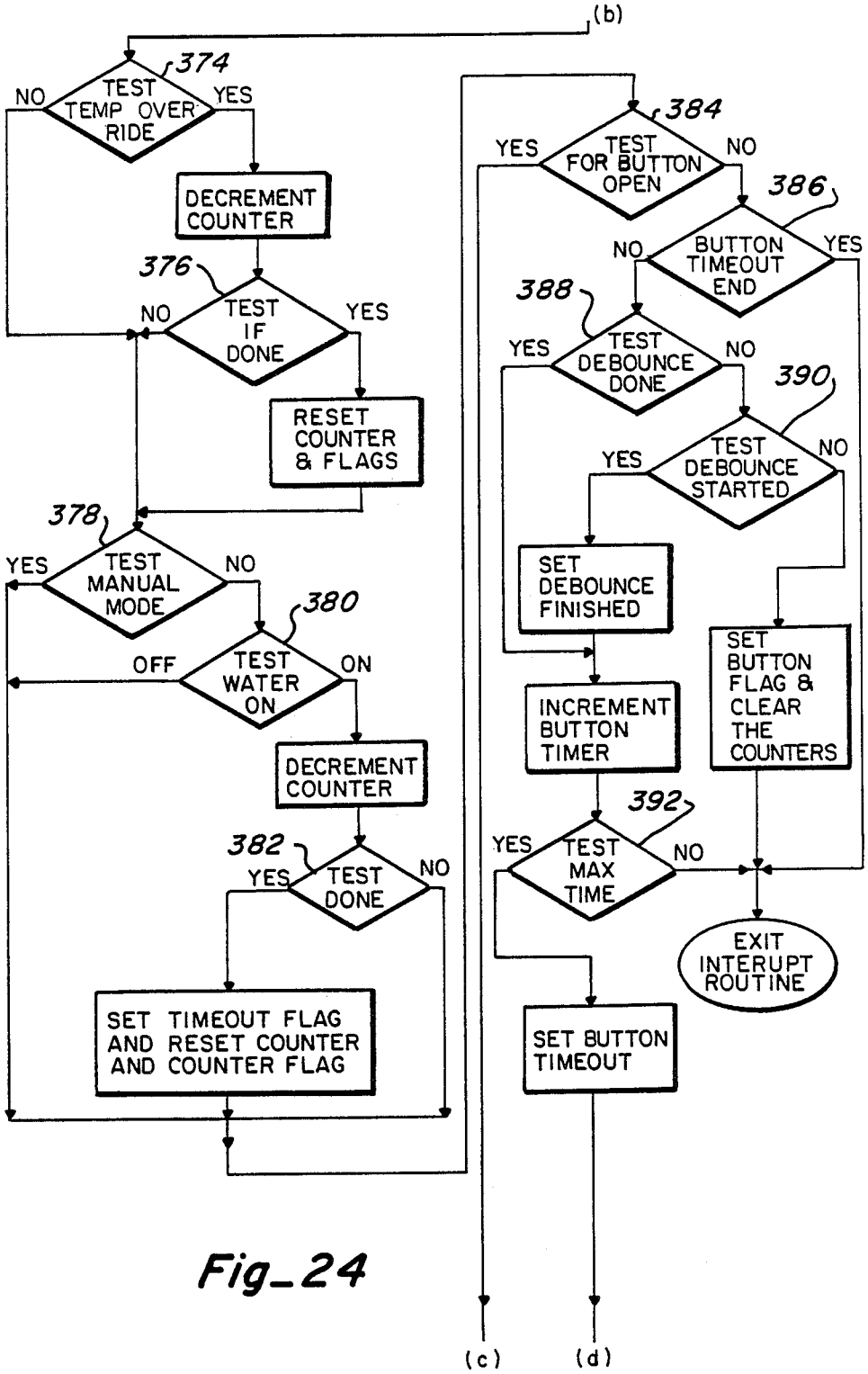

In FIG. 24, the logic determines by the test at block 374 whether a temperature override condition exists. If so, then the 20 sec. counter is decremented. At block 376, if 20 secs. has passed, then the counter and flags are reset. It is determined at block 378 whether or not the manual mode is in effect. If the faucet 10 is in the automatic mode, then it is determined whether water is flowing at block 380, and if so, the one minute time out counter is decremented, and if done as determined at block 382, the counter and flag are reset.

The balance of FIG. 24 and FIG. 25 concern pushbutton 20 and its use in the electronic faucet 10. At block 384, it is determined whether or not the button is open. If the button has been closed, the test at block 384 being answered "no", then block 386 determines whether or not 6 secs. have passed since the button closed, which time is the time the button 20 needs to be held in order to program the spout position sensing means. If 6 secs. has passed, then the interrupt routine is exitted. If not, the debounce done flag is tested at block 388. Debounce is the time required for the mechanical button to cease vibrating and establish contact, 100 msecs. for the button employed in the preferred embodiment. If the debounce is not done, the debounce started flag is tested at block 390. If the debounce has not started, as determined at block 390, the debounce started flag is set and the button counter is cleared. If the debounce has started, as determined at block 390, then the debounce finished flag is set.

If at block 388, the debounce done flag is present, the button timer is decremented and a test done at block 392 to see if the time has reached the 6 sec. time out period. If not, then the interrupt routine is exitted. If the time out period has been reached, the time out flag is set.

If the debounce flag is present after the first test of a button release, the debounce flag is tested at block 394 of FIG. 25. If the debounce flag is set, the flag is cleared. If either the debounce started or the debounce done flag is clear, as tested at blocks 394 and 396, then the interrupt routine is exitted.

At block 398, the button timer is tested. The first test is for manual mode where the button 20 is pressed and released for a predetermined time of less than 2 secs. at block 400. At block 402, it is determined whether or not a manual mode change has been made. If the manual mode is off, the O zone is checked at block 404. If zone O is present, then the interrupt routine is exitted, and water is not turned on. If it is determined at block 404 that the spout is not in the O zone, then the green LED 204 is turned off, indicating not in the automatic mode, and the water on timer is set.

If, at block 402, it is determined that the manual mode is on, then the water is turned off and the manual mode flag is cleared.

The second action tested at block 406 is whether or not the temperature override function is present. If the button 20 has been depressed for more than 2 secs., as determined at block 398, the botton time out is cleared and the green LED 204 toggled. The zone presently sensed by the spout position sensing means is changed from active in the automatic mode to inactive in the automatic mode, and water is shut off, if it is flowing.

Although the invention has been described with a certain degree of particularity, the scope of the invention is set forth in the following claims and their equivalents.

What is claimed is:

1. A water faucet having a spout swivelably connected to a body for controlling a water supply of hot and cold water comprising in combination:

detection means for sensing the presence of an object near an outlet of said spout;

a water flow control valve operative on said detection means for opening and closing a water flow passageway in fluid communication with said water supply; and spout position sensing means for enabling or disabling said detection means in an automatic mode when said spout is in any one of a plurality of predetermined angular positions, said spout position sensing means for determining the augular position of said spout, said faucet operating in an automatic mode operative on said detection means when said detection means is enabled and in a manual mode, operative on an on/off input signal, when said detection means is disabled.

2. The invention is defined in claim 1 wherein said detection means furhter includes emitter means for periodically transmitting a signal and sensor means for receiving a reflected signal transmitted by said emitter means, said emitter means turned on at times when said sensor means is on, said sensor means turned on and off for preselected periods of time during a cycle of time and, if a signal is sensed by said sensor means when said emitter means is off, said detection means preventing the water flow control valve from turning on, and, if no signal is sensed by said sensor means when said emitter means is off and the reflected signal is sensed by said sensor means when said emitter means is on, said detection means then turning on the water flow control valve.

3. The invention as defined in claim 1 further including a rotary mixing valve providing for selective communication between said water flow passageway and hot and cold water lines, said rotary mixing valve rotatable about an axis and in sliding contact with an interior surface of a deformable seal, an exterior surface of said deformable seal in sealing contact with hot and cold inlet passageways in a first position and upon rotation of the cam, said deformable seal moving away from one of said inlet passageways to admit a greater flow of hot or cold water to said water flow passageway.

4. The invention as defined in claim 3 wherein a spray wash line is in communication with said water flow passageway at a point between the mixing valve and the water flow control valve, said faucet further including back flow prevention means for preventing back water flow of said spray wash, said back flow prevention means including said deformable seal of said rotary mixing valve operative on negative pressure in said water faucet to seal said water supply from back flow, a standpipe extending into said body above a maximum water height in a sink associated with said water faucet, and a relief cavity into which said standpipe projects, said relief cavity being vented to atmospheric pressure through a diaphragm in the water flow control valve which is normally open under low water pressure.

5. The invention as defined in claim 1 wherein said water faucet further includes means for comparing a water supply temperature to a predetermined temperature and forcing said water flow control valve off if said water suppy temperature is greater than said predetermined temperature.

6. The invention as defined in claim 5 wherein said means for comparing a water supply temperature to a predetermined temperature further includes means for supplying audio and visual indications if said supply temperature exceeds said predetermined temperature.

7. The invention as defined in claim 6 wherein a pushbutton input signal turns on the water flow control valve.

8. The invention as defined in claim 5 wherein a pushbutton input signal turns said water flow control valve on whatever the water supply temperature.

9. In an automatic water flow control device having control means for sensing an object near a water outlet of said device, said outlet moveable through an arc, said control means activating water flow in an automatic mode through said device if an object is sensed, the improvement comprising outlet position sensing means for activating or deactivating automatic water flow dependent upon the angular position of said outlet within said arc, said position sensing means further including programmable input means to said control means for selectively changing the angular position of said outlet within said arc in which water flow in the automatic mode occurs.

10. The invention as defined in claim 9 wherein said programmable input means further includes a push-button input for turning on the water flow control device regardless of the angular position of said outlet.

11. The invention as defined in claim 9 wherein said detection means further includes emitter means for periodically transmitting a signal and sensor means for receiving a reflected signal transmitted by said emitter means, said emitter means turned on at times when said sensor means is on, said sensor means turned on and off for preselected periods of time during a cycle of time and, if a signal is sensed by said sensor means when said emitter means is off, said detection means preventing the water flow control device from turning on, and, if no signal is sensed by said sensor means when said emitter means is off and the reflected signal is sensed by said sensor means when said emitter means is no, said detection means then turning on the water flow control valve.

12. The invention as defined in claim 9 further including a rotary mixing valve providing for selective communication between a water flow passageway through said device and hot and cold water lines, said rotary mixing valve rotatable about an axis and in sliding contact with an interior surface of a deformable seal, an exterior surface of said deformable seal in sealing contact with hot and cold inlet passageways in a first position and upon rotation of the cam, said deformable seal moving away from one of said inlet passageways to admit a greater flow of hot or cold water to said water flow passageway.

13. The invention as defined in claim 12 wherein a spray wash line is in communication with said water flow passageway at a point between the mixing valve and a water flow control valve, said device further including back flow prevention means for preventing back water flow of said spray wash, said back flow prevention means including said deformable seal of said rotary mixing valve operative on negative pressure in said water faucet to seal said water supply, a standpipe extending into said body above a maximum water height in a sink associated with said water faucet, and a relief cavity into which said standpipe projects, said relief cavity being vented to atmospheric pressure through a diaphragm in the water flow control valve which is normally open under low water pressure.

14. The invention as defined in claim 9 wherein said control device further includes means for comparing a water supply temperature to a predetermined temperature and forcing said water flow control device off if said water suppy temperature is greater than said predetermined temperature.

15. The invention as defined in claim 14 wherein said means for comparing a water supply temperature to a predetermined temperature further includes means for supplying audio and visual indications if said supply temperature exceeds said predetermined temperature.

16. The invention as defined in claim 15 wherein a pushbutton input signal turns on the control device.

17. The invention as defined in claim 14 wherein a pushbutton input signal turns said water flow control valve on whatever the water supply temperature.

18. An electronic water faucet comprising in combination:

a body having a spout swivelably connected thereto, said body receiving water from a water supply through a passageway, said passageway communicating with a second passageway formed in said spout and terminating at an outlet;

control means for sensing an object near said outlet and activating water flow through said faucet in an automatic mode, water flow deactivated in said automatic mode if a water supply temperature is greater than a predetermined water temperature, said faucet operable in a manual mode selected by a signal generated from programmable input means for less than a first preselected time, said signal operative through said control means to activate water flow, generation of a second signal lasting more than said first predetermined time and less than a second predetermined time by said input means activating water flow when the water supply temperature is greater than the predetermined value, and generation of a third signal lasting more than the second predetermined time, operating through said control means to disable the automatic mode when the spout is in a predefined, angular position.

19. The invention as defined in claim 18 wherein said control means further includes spout position sensing means for first reading the angular position of said spout and then providing a coded input to said control means for determining whether said automatic mode will be enabled or disabled for the particular angular position of the spout.

20. The invention as defined in claim 19 wherein said spout position sensing means further includes a coded bar graph stationarily mounted with respect to said body, said bar graph including indicia thereon for reflecting or not reflecting a signal transmitted thereto by a emitter angled with respect to a surface of said coded graph, said emitter signal being reflected off said coded graph to be received by a sensor, said sensor generating said coded input to said control means a high or a low signal depending upon the indicia upon said coded graph.

21. The invention as defined in claim 20 wherein said coded graph is divided into seven coded zones wherein the faucet can be programmed to be on in the automatic mode and a zone wherein the faucet is always off, and where there are three sensor-emitter pairs superimposed over each other to read three rows of said coded graph to thereby generate a three-bit coded input to said control means.

22. The invention as defined in claim 18 further including a rotary mixing valve providing for selective communication between said first passageway and hot and cold water lines, said rotary mixing valve rotatable about an axis and in sliding contact with an interior surface of a deformable seal, an exterior surface of said deformable seal in sealing contact with hot and cold inlet passageways in a first position and upon rotation of the cam, said deformable seal moving away from one of said inlet passageways to admit a greater flow of hot or cold water to said first passageway.

23. The invention as defined in claim 18 wherein a spray wash line is in communication with said first passageway downstream of the mixing valve, said faucet further including back flow prevention means for preventing back water flow of said spray wash, said back flow prevention means including said deformable seal of said rotary mixing valve operative on negative pressure in said water faucet to seal said water supply from back flow, a standpipe extending into said body above a maximum water height in a sink associated with said water faucet, and a relief cavity into which said standpipe projects, said relief cavity being vented to atmospheric pressure through a diaphragm in the faucet which is normally open under low water pressure.

24. An electronic faucet comprising in combination:

a body for receiving a water supply, which water supply is turned on or off by a water flow control device, said body having a spout swivelably connected thereto in fluid communication with said water supply, an outlet of said spout for discharging water flow; and control means for turning said water flow control device on and off said control means including detection means for sensing an object near said outlet and spout position sensing means for reading the angular position of the spout and enabling or disabling the water flow control device in an automatic mode dependent upon the angular position of said spout as sensed by the spout position sensing means, said spout position sensing means including a coded graph mounted stationarily with respect to said body and an emitter and sensor pair mounted for rotational movement with said spout, said emitter generating a signal to be reflected on said graph to be received by said sensor, said sensor generating an input signal to said control means dependent upon the signal generated by said sensor and reflected off said graph, enabling or disabling the automatic mode for a given spout position.

25. The invention as defined in claim 24 wherein there are three superimposed emitter and sensor pairs, each emitter and senor pair associated with a distinct row on said coded graph, said coded graph further divided into zones corresponding to angles of arc of rotation of the spout.

26. The invention as defined in claim 25 wherein said coded graph includes seven zones of equal arc length wherein the automatic mode can be enabled or disabled and a O zone where no automatic mode operation can occur.

* * * * *